US007047729B2

(12) United States Patent
van Nieuwstadt et al.

(10) Patent No.: US 7,047,729 B2
(45) Date of Patent: May 23, 2006

(54) CONTROL METHOD AND SYSTEM FOR DIESEL PARTICULATE FILTER REGENERATION

(75) Inventors: Michiel van Nieuwstadt, Ann Arbor, MI (US); Paul Tennison, Oak Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 204 days.

(21) Appl. No.: 10/694,498

(22) Filed: Oct. 27, 2003

(65) Prior Publication Data

US 2005/0086929 A1 Apr. 28, 2005

(51) Int. Cl.
*F01N 3/00* (2006.01)

(52) U.S. Cl. ..... 60/286; 60/274; 60/295; 60/297; 60/311

(58) Field of Classification Search ..... 60/274, 60/286, 295, 297, 311
See application file for complete search history.

(56) References Cited

U.S. PATENT DOCUMENTS 4,450,682 A * 5/1984 Sato et al. ..... 60/286
4,535,588 A * 8/1985 Sato et al. ..... 60/286
5,193,340 A * 3/1993 Kamihara ..... 60/286
5,207,990 A * 5/1993 Sekiya et al. ..... 422/183
5,908,480 A 6/1999 Ban et al.
5,961,931 A 10/1999 Ban et al.
6,322,605 B1 11/2001 He et al.
6,397,587 B1 6/2002 van Nieuwstadt et al.
6,497,095 B1 * 12/2002 Carberry et al. ..... 60/295
6,568,173 B1 5/2003 Kolmanovsky et al.
6,594,990 B1 7/2003 Kuenstler et al.
6,666,020 B1 * 12/2003 Tonetti et al. ..... 60/286

* cited by examiner

*Primary Examiner*—Thomas Denion
*Assistant Examiner*—Diem Tran
(74) *Attorney, Agent, or Firm*—Julia Voutyras; Richard M. Sharkansky

(57) ABSTRACT

A method and system for controlling regeneration in a particulate filter coupled to an internal combustion engine. The method controls hydrocarbon injection into engine exhaust upstream of an oxidation catalyst disposed upstream of the particulate filter in accordance an algebraic sum of a feedforward term and a feedback term. The feedforward term is a function of a difference between with the engine exhaust temperature upstream of the catalyst and a predetermined desired particulate filter temperature. The feedback term is a function of a temperature of the particulate filter and the predetermined desired particulate filter temperature.

21 Claims, 2 Drawing Sheets

CONTROL METHOD AND SYSTEM FOR DIESEL PARTICULATE FILTER REGENERATION

TECHNICAL FIELD

The present invention relates to engine control strategies for engines and, more particularly, control methods for diesel engines having a diesel particulate filter (DPF).

BACKGROUND

As is known in the art, North American diesel trucks and cars will be equipped with diesel particulate filters (DPFs) to meet stringent emission standards for particulate matter (0.01 g/m for light duty, 0.01 g/bhphr for heavy duty). DPFs collect soot through a wall filtering process. Increasing soot load on the DPF increases the back pressure which has a negative effect on fuel economy. Hence this soot must be burnt off (regenerated) every several 100s of miles to keep the back pressure down. The use of a downstream hydrocarbon injector, injecting atomized diesel fuel into the exhaust manifold or in the downpipe after the turbocharger has been suggested to aid in regenerating the DPF.

SUMMARY

In accordance with the present invention a method and system are provided for controlling regeneration in a particulate filter coupled to an internal combustion engine. The method controls hydrocarbon injection into engine exhaust upstream of an oxidation catalyst disposed upstream of the particulate filter in accordance with a difference between the engine exhaust temperature upstream of the catalyst and a desired particulate filter temperature.

In one embodiment, the hydrocarbon injection control is a function of at least an engine operating condition and ambient conditions.

In one embodiment, the hydrocarbon injection control includes a feedback term, such feedback term being a function of a difference between a temperature representative of the temperature of the particulate filter and the desired particulate filter temperature.

In one embodiment, the feedback term is the output of a limited PI controller with an input to such PI controller being the difference between a temperature associated with the particulate filter and a desired particulate filter temperature.

In accordance with the invention, a method and system are provided for controlling regeneration in a particulate filter coupled to an internal combustion engine. The method controls hydrocarbon injection into engine exhaust upstream of an oxidation catalyst disposed upstream of the particulate filter in accordance an algebraic sum of a feedforward term and a feedback term. The feedforward term is a function of a difference between with the engine exhaust temperature upstream of the catalyst and a predetermined desired particulate filter temperature. The feedback term is a function of a temperature of the particulate filter and the predetermined desired particulate filter temperature.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
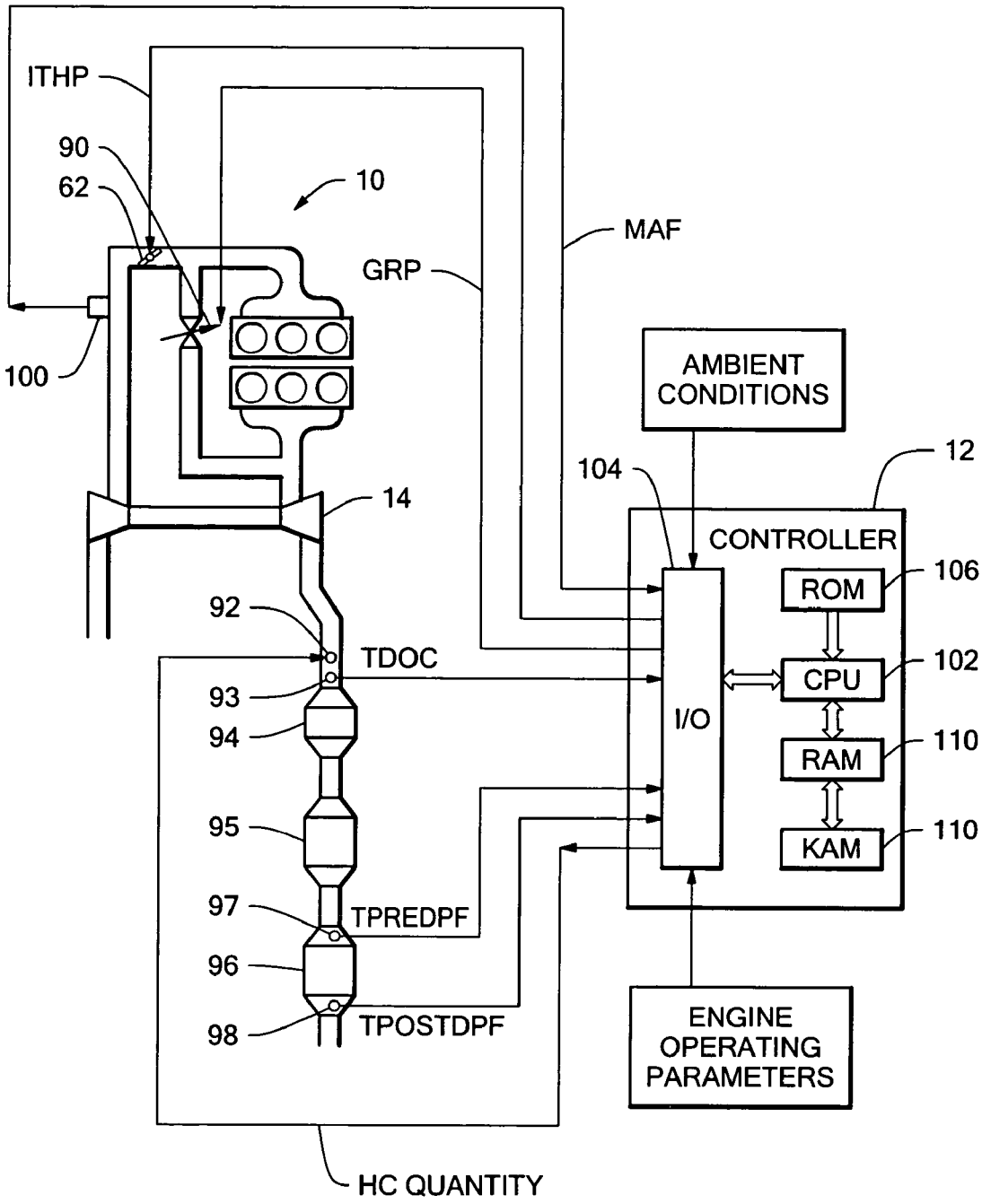
FIG. 1 is a diagram of an engine system according to the invention.

Referring now to FIG. 1, a schematic diagram of the engine system is described. Engine 10 is shown coupled to a turbo charger 14. Turbo charger 14 can be any number of types, including a single stage turbo charge, a variable geometry turbo charger, a dual fixed geometry (one for each bank), or a dual variable geometry turbo charger (one for each bank).

Intake throttle 62 is shown for controlling manifold pressure and air flow entering the engine 10. In addition, EGR valve 90 is shown for controlling recirculated exhaust gas entering the intake manifold of engine 10. In the exhaust system, downstream of turbocharger 14 is HC injector 92. Disposed at the entrance of an oxidation catalyst 94 is a temperature sensor 93. The temperature signal produced by the temperature sensor 93 is here represented by Tpredoc.

A second oxidation catalyst 95 may also be used but may also be eliminated. The oxidation catalyst can be of various types, such as, for example, an active lean NOx catalyst.

Further downstream of catalyst 95 is located a diesel particulate filter (DPF) 96. A second temperature sensor 97 is located upstream of the particulate filter 96 and produces a temperature signal Tpredpf and a third temperature sensor 98 is located downstream of the particulate filter 96 and produces a temperature signal Tpostdpf. The particulate filter is typically made of SiC, NZP and cordierite, with SiC being the most temperature resistant, and cordierite the least. Further, independent of the material used, self-sustained filter regeneration can be obtained simply by raising the particulate filter to a high enough temperature.

Each of the sensors described above provides a measurement indication to controller 12 as described below herein. Further, throttle position and EGR valve position are controlled via a controller 12 as described later herein.

Controller 12 is a conventional unit 102, input/output ports 104, an electronic storage medium for executable programs and calibration values shown as read-only memory semiconductor chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100. Also fed to the controller 12 are other engine operating conditions and ambient conditions A method and system are provided for controlling regeneration in a particulate filter coupled to an internal combustion engine. The method controls hydrocarbon injection via injector 92 into engine exhaust upstream of an oxidation catalyst 94 disposed upstream of the particulate filter 96 in accordance an algebraic sum of a feedforward term HC_ff (FIG. 2) and a feedback term (HC_fb). The feedforward term is a function of a difference between with the engine exhaust temperature upstream of the catalyst Tpredoc and a predetermined desired particulate filter temperature Tdpf_des. The feedback term is a function of a temperature of the particulate filter Tdpf and the predetermined desired particulate filter regeneration temperature Tdpf_des.

Figure 2:
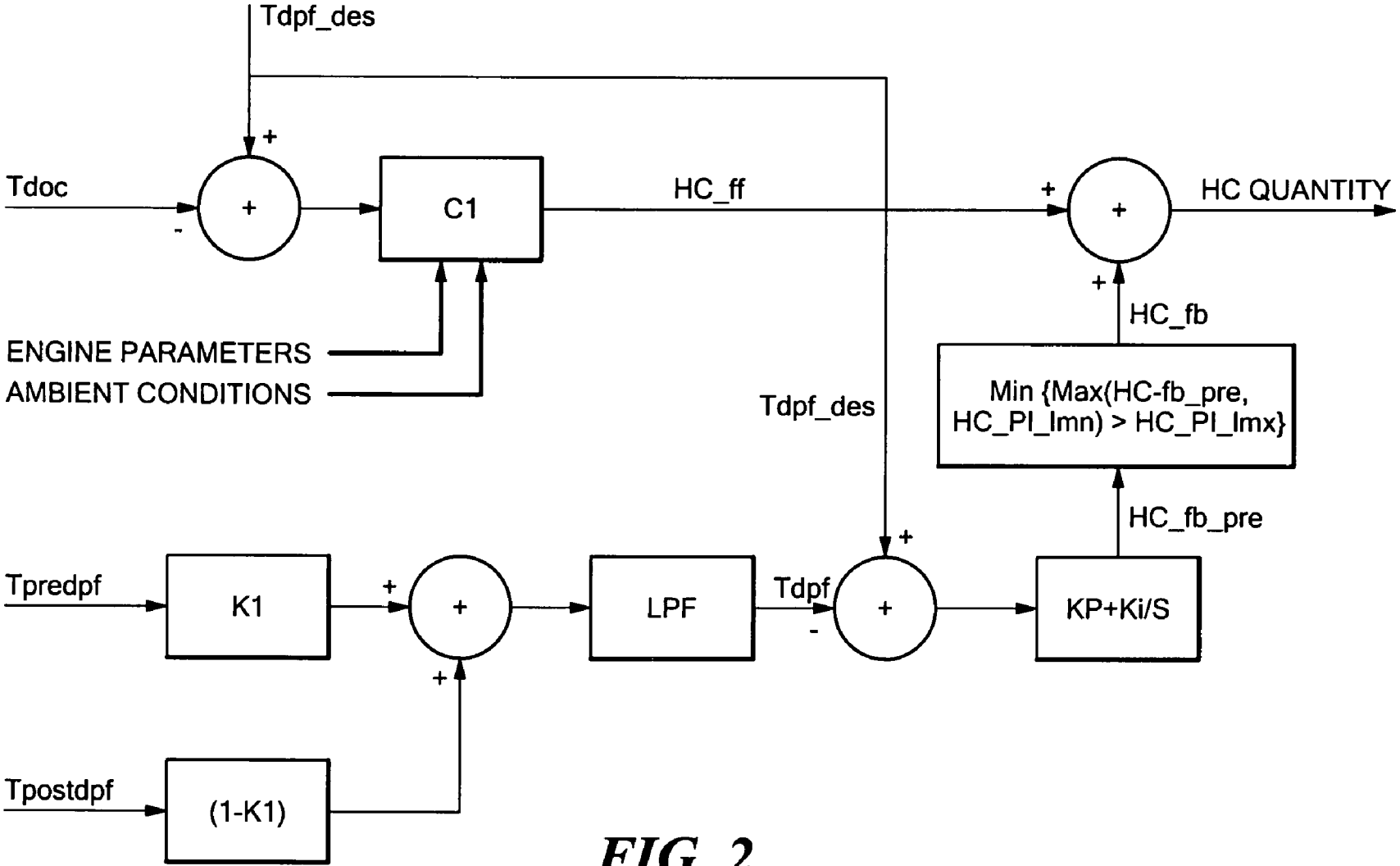
FIG. 2 is a block diagram of a control system used in the engine system of FIG. 1 according to the invention.

Thus, the control strategy, executed by the controller 12 in accordance with a computer program stored in the ROM 106, computes a command to the HC injector 92 (HC QUANTITY) composed of a feed forward, HC_ff and feedback term, HC_fb, as shown in FIG. 2. The feedforward term, HC_ff computes a nominal quantity aimed to raise the pre DPF temperature based on the temperature of the oxidation catalyst 94, Tpredoc:

$$HC_ff=c_1*(T\text{dpf_des}-T\text{predoc});$$

where: c_1 is a constant taking into account the lower heating value of diesel fuel and the heat capacity of the exhaust flow. The constant c_1 may also be a function of engine operating and ambient conditions. In the absence of uncertainty this feed forward term, HC_ff will bring the DPF temperature to its desired value, Tdpf_des.

The feedback term HC_fb is added to this amount to account HC_ff for uncertainties in engine conditions, ambient conditions, and the effect they have on temperature Tpredoc increase:

$$HC_fb_\text{pre}=(Kp+Ki/s)*(T\text{dpf_des}-T\text{dpf}),$$

HC_fb=min(max(HC_fb_pre, HC_PI_lmn), HC_PI_lmx), as shown in FIG. 2, where:

where:

HC_PI_lmx is an upper limit on the feedback correction;

HC_PI_lmn is a lower limit on the feedback correction;

Kp is a proportional gain constant;

Ki is an integration gain constant; and s is the Laplace operator; and

That is, the feedback term HC_fb is the output of a limited PI controller (FIG. 2) with as input to such PI controller being the difference between measure and desired temperature difference (i.e., Tdpf_des−Tdpf). The limits ensure that the contribution of the feedback term HC_fb does not grow too large, since too much HC injection may result in damage of the DPF.

In a typical implementation, the DPF temperature is calculated from a weighted and low pass filtered average of pre- and post-DPF temperatures Tpredpf and Tpostdpf, respectively, in order to account for the fact that temperature is a distributed quantity and that the DPF has a thermal inertia:

$$T\text{dpf}=LP(s)*(k1*T\text{predpf}+(1-k1)*T\text{postdpf});$$

where: If k1=1, the DPF temperature is equated to the pre-DPF temperature, and the post-DPF temperature sensor 98 can be removed. Conversely, the pre-DPF temperature sensor 97 can be omitted if k1=0. The value of k1 is selected by a calibration based on raw sensor data and performance of off-line signal processing to find the optimum value for k1 during development of the particular engine.

Similarly, the pre-oxidation catalyst temperature Tpredoc can be replaced by an estimate of the oxidation catalyst temperature Tdoc which is a low pass filtered weighted average of pre- and post DOC temperatures, (the post DOC temperature is given by the pre-DPF temperature sensor) and equivalent sensors can be removed depending on the weighting factor between pre- and post DOC temperatures.

The final HC quantity to be injected is then:

$$HC\ \text{QUANTITY}=HC_\text{inj}=HC_ff+HC_fb.$$

This quantity can be expressed in units of mg/sec, or preferably in ppm. The latter solution will automatically compensate for the changing heat capacity and cooling effect of the flow rate that result from a changing exhaust flow. If the quantity HC_inj is expressed in ppm, it has to be converted to mg/sec by taking into account the current exhaust flow.

Due to the thermal inertia of the DPF, it will stay at high temperature for a while after it reaches its desired temperature. This means that HC injection is not required any more after Tdpf reaches Tdpf_des. Thus, an advantage can be obtained by turning off the HC injection when Tdpf reached Tdpf_des thereby providing an oxygen boost that accelerates DPF regeneration. However, sue of such effect may or may not be used depending on the values for Tdpf_des and the thermal inertia of the DPF and the exhaust flow.

A number of embodiments of the invention have been described. Nevertheless, it will be understood that various modifications may be made without departing from the spirit and scope of the invention. Accordingly, other embodiments are within the scope of the following claims.

What is claimed is:

1. A method for controlling regeneration in a particulate filter coupled to an internal combustion engine, comprising:

controlling hydrocarbon injection into engine exhaust upstream of an oxidation catalyst disposed upstream of the particulate filter in accordance with a difference between the engine exhaust temperature upstream of the catalyst and a temperature in a region both downstream of the catalyst and upstream of the particulate filter.

2. The method recited in claim 1 wherein the predetermined desired particulate filter temperature is a temperature for regeneration within the filter.

3. A method for controlling regeneration in a particulate filter coupled to an internal combustion engine, comprising:

controlling hydrocarbon injection into engine exhaust upstream of an oxidation catalyst disposed upstream of the particulate filter in accordance with a difference between the engine exhaust temperature upstream of the catalyst and a desired particulate filter regeneration temperature; and wherein the hydrocarbon injection control is a function of at least an engine operating condition and ambient conditions.

4. A method for controlling regeneration in a particulate filter coupled to an internal combustion engine, comprising:

controlling hydrocarbon injection into engine exhaust upstream of an oxidation catalyst disposed upstream of the particulate filter in accordance with a difference between the engine exhaust temperature upstream of the catalyst and a desired particulate filter regeneration temperature; and wherein the hydrocarbon injection control is a function of a difference between a temperature of the engine exhaust in a region between the catalyst and an entrance to the filter and a temperature of the engine exhaust downstream of the filter.

5. A method for controlling regeneration in a particulate filter coupled to an internal combustion engine, comprising:

controlling hydrocarbon injection into engine exhaust upstream of an oxidation catalyst disposed upstream of the particulate filter in accordance with a difference between the engine exhaust temperature upstream of the catalyst and a desired particulate filter regeneration temperature; and wherein the hydrocarbon injection control is also a function of a feedback term, such feedback term being a function of a temperature of the particulate filter and the predetermined desired particulate filter temperature.

6. The method recited in claim 5 wherein the feedback term is an output of a limited PI controller with an input to such PI controller being the difference between a temperature associated with the particulate filter and a desired particulate filter temperature.

7. A method for controlling regeneration in a particulate filter coupled to an internal combustion engine, comprising:

controlling hydrocarbon injection into engine exhaust upstream of an oxidation catalyst disposed upstream of the particulate filter in accordance an algebraic sum of a feedforward term and a feedback term, such feedforward term being a function of a difference between with the engine exhaust temperature upstream of the catalyst and a predetermined desired particulate filter temperature and such feedback term being a function of a temperature of the particulate filter and the predetermined desired particulate filter temperature.

8. The method recited in claim 7 wherein the predetermined desired particulate filter temperature is a temperature for regeneration within the filter.

9. The method recited in claim 7 wherein the hydrocarbon injection control is a function of at least an engine operating condition and ambient conditions.

10. The method recited in claim 7 wherein the hydrocarbon injection control is a function of a difference between a temperature of the engine exhaust in a region between the catalyst and an entrance to the filter and a temperature of the engine exhaust downstream of the filter.

11. The method recited in claim 7 wherein the feedback term is an output of a limited PI controller with an input to such PI controller being the difference between a temperature associated with the particulate filter and a desired particulate filter temperature.

12. An engine control system comprising:

an internal combustion engine;

a particulate filter coupled to an internal combustion engine;

an oxidation catalyst disposed upstream of the particulate filter; and a controller for controlling hydrocarbon injection into engine exhaust upstream of the oxidation catalyst in accordance with a difference between the engine exhaust temperature upstream of the catalyst and a temperature in a region both downstream of the catalyst and upstream of the particulate filter.

13. The system recited in claim 12 wherein the predetermined desired particulate filter temperature is a temperature for regeneration within the filter.

14. An engine control system comprising:

an internal combustion engine;

a particulate filter coupled to an internal combustion engine;

an oxidation catalyst disposed upstream of the particulate filter; and a controller for controlling hydrocarbon injection into engine exhaust upstream of the oxidation catalyst in accordance with a difference between the engine exhaust temperature upstream of the catalyst and a desired particulate filter regeneration temperature; and wherein the hydrocarbon injection control is a function of at least an engine operating condition and ambient conditions.

15. An engine control system comprising:

an internal combustion engine;

a particulate filter coupled to an internal combustion engine;

an oxidation catalyst disposed upstream of the particulate filter; and a controller for controlling hydrocarbon injection into engine exhaust upstream of the oxidation catalyst in accordance with a difference between the engine exhaust temperature upstream of the catalyst and a desired particulate filter regeneration temperature; and wherein the hydrocarbon injection control is a function of a difference between a temperature of the engine exhaust in a region between the catalyst and an entrance to the filter and a temperature of the engine exhaust downstream of the filter.

16. An engine control system comprising:

an internal combustion engine;

a particulate filter coupled to an internal combustion engine;

an oxidation catalyst disposed upstream of the particulate filter; and a controller for controlling hydrocarbon injection into engine exhaust upstream of the oxidation catalyst in accordance with a difference between the engine exhaust temperature upstream of the catalyst and a desired particulate filter regeneration temperature; and wherein the hydrocarbon injection control is also a function of a feedback term, such feedback term being a function of a temperature of the particulate filter and the predetermined desired particulate filter temperature.

17. The system recited in claim 16 wherein the feedback term is an output of a limited PI controller with an output to such PI controller being the difference between a temperature associated with the particulate filter and a desired particulate filter temperature.

18. A system, comprising:

an internal combustion engine;

in a particulate filter coupled to an internal combustion engine;

an oxidation catalyst disposed upstream of the particulate filter; and a controller for controlling hydrocarbon injection into engine exhaust upstream of the oxidation catalyst in accordance an algebraic sum of a feedforward term and a feedback term, such feedforward term being a function of a difference between with the engine exhaust temperature upstream of the catalyst and a predetermined desired particulate filter temperature and such feedback term being a function of a temperature of the particulate filter and the predetermined desired particulate filter temperature.

19. The system recited in claim 18 wherein the predetermined desired particulate filter temperature is a temperature for regeneration within the filter.

20. An article of manufacture comprising:

a computer storage medium having a program encoded for controlling regeneration in a particulate filter coupled to an internal combustion engine, such computer storage medium comprising:

code for controlling hydrocarbon injection into engine exhaust upstream of an oxidation catalyst disposed upstream of the particulate filter in accordance with a difference between the engine exhaust temperature upstream of the catalyst and a temperature in a region both downstream of the catalyst and upstream of the particulate filter.

21. The article of manufacture recited in claim 20 wherein the computer storage medium is a semiconductor chip.

* * * * *